United States Patent [19]

Bowe

[11] Patent Number: 4,881,854

[45] Date of Patent: Nov. 21, 1989

[54] PRESSURE ACTIVATED FLUID RETAINING SYSTEM AND METHOD

[75] Inventor: Gerald J. Bowe, Eau Claire, Wis.

[73] Assignee: JBI Corporation, Osseo, Wis.

[21] Appl. No.: 233,234

[22] Filed: Aug. 17, 1988

[51] Int. Cl.[4] ..... E02B 7/00

[52] U.S. Cl. ..... 405/303; 405/115

[58] Field of Search ..... 405/87, 115, 303; 52/169.1; 169/5, 11

[56] References Cited

U.S. PATENT DOCUMENTS 2,097,908 11/1937 Allen .
2,757,045 7/1956 Nullet .
4,202,646 5/1980 Herstad .
4,276,064 6/1981 Gerdes .
4,305,469 12/1981 Morrisette .
4,314,774 2/1982 Tsuji et al. ..... 405/115
4,352,591 10/1982 Thompson ..... 405/87
4,657,086 4/1987 Aanensen .

*Primary Examiner*—David H. Corbin
*Attorney, Agent, or Firm*—Merchant, Gould, Smith, Edell, Welter & Schmidt

[57] ABSTRACT

Disclosed is a pressure activated fluid retaining system and method. A flexible inflatable member in the form of hose means is positioned beneath threshold means. The threshold means is movable between a horizontal position and a vertical position. The hose means is selectively pressurized and expanded so that it contacts and moves the threshold means from the horizontal position to the fluid retaining vertical position.

26 Claims, 3 Drawing Sheets

PRESSURE ACTIVATED FLUID RETAINING SYSTEM AND METHOD

FIELD OF THE INVENTION

The present invention relates generally to the field of fluid retaining dams and more specifically to a system used to retain expended fire fighting liquids within an enclosure.

BACKGROUND OF THE INVENTION

Various enclosures, such as airplane hangers, spray painting booths, and the like, are configured with fire suppression systems. These fire suppression systems typically include fire fighting liquids such as water or foam. Upon activation of the fire suppression systems, the fire fighting liquids are released into the enclosure. Often the volume of the fire fighting liquids results in outflow of the liquids from the enclosure.

The flow of fire fighting liquids out of an enclosure creates various hazards. The possibility of spreading toxic chemicals, resulting from a fire, outside of an enclosure is of great concern. Also, fire fighting liquids which are designed to smother the oxygen of fires may escape into sewer systems adjacent the enclosure and prevent proper biologic action of waste products due to similar oxygen smothering effects. Other disadvantages of permitting flow of fire fighting liquids beyond enclosures include possible electric shorting of equipment, creation of slippery work surfaces, and environmental damage.

Yet another problem occurs around structures or equipment which discharge liquids or drippings under certain circumstances. In those cases, hazards resulting from such discharges or emissions may be similar to those noted above.

What has been needed, therefore, has been a system which retains liquids within a defined area surrounding a particular object. What has been further needed is a fluid retaining system which permits movement of wheeled equipment into and out of the defined area when the system is not in a fluid retaining configuration.

SUMMARY OF THE INVENTION

A system is provided for retaining liquids within an enclosure. The system includes threshold means which is located on a base surface of the enclosure, the threshold means having an upper surface, a lower surface, and two end sections. The threshold means is movable between a first horizontal position and a second vertical position. A flexible inflatable member in the form of a hose means is positioned beneath the threshold means. The hose means is selectively pressurized and expanded so that it contacts and imparts movement to the threshold means. The threshold means is thus moved from the horizontal position to the vertical position to effectively retain expended fire fighting liquids within the enclosure.

DETAILED DESCRIPTION OF THE PREFERRED EMBODIMENTS

Detailed preferred embodiments of the present invention are disclosed. It is to be understood, however, that the disclosed embodiments are merely exemplary of the invention, which may be embodied in various forms. Therefore, specific structural and functional details disclosed are not to be interpreted as limiting, but rather as a representative basis for teaching one skilled in the art to variously employ the present invention and virtually any appropriately detailed system or structure. It will be understood that in some circumstances relative material thicknesses and relative component sizes may be shown exaggerated to facilitate an understanding of the invention.

Figure 1:
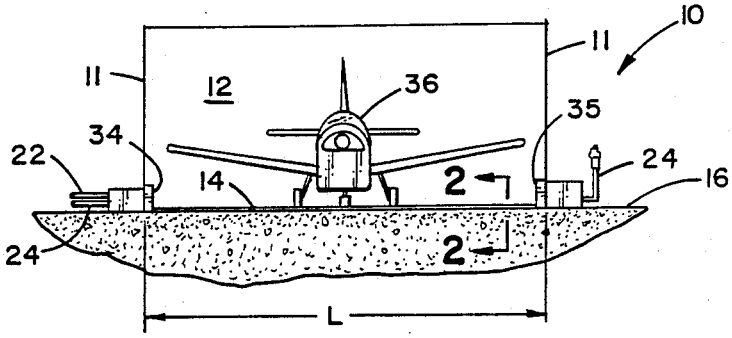
FIG. 1 is a front elevation view of a representative enclosure having a pressure activated fluid retaining system configured across an opening therein.

Referring to FIG. 1, an enclosure 10 is illustrated having several walls 11 and an access opening 12. A system 14 for retaining liquids within enclosure 10 is positioned across access opening 12 on the base surface 16 of enclosure 10. As will be further described, system 14 is constructed to retain liquids within enclosure 10 when the device is actuated.

Figure 2:
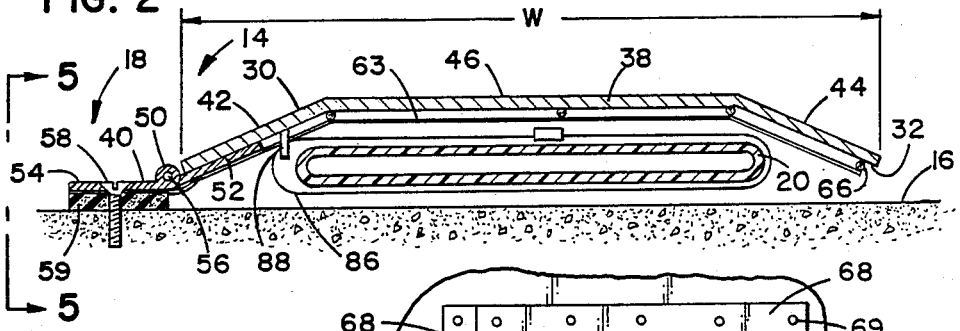
FIG. 2 is a side cross sectional view of a preferred embodiment fluid retaining system taken generally along Line 2—2, FIG. 1, illustrating a depressurized hose means positioned beneath a preferred embodiment horizontally oriented and rotatable threshold means.

FIG. 2 is a side cross sectional view of a portion of preferred embodiment system 14 showing threshold means 18 and a flexible inflatable member in the form of hose means 20. Pressurization means 22, and vent means 24, illustrated in FIG. 1, which provide means for pressurizing and venting hose means 20 will be further illustrated and described in relation to subsequent figures.

FIGS. 1 and 2 show that threshold means 18 is preferably located on base surface 16 of enclosure 10 and has an upper surface 30, a lower surface 32, and two end sections 34, 35. Hose means 20 is positioned beneath the length L of threshold means 18 and is constructed and arranged to be pressurized. Pressurization means 22, connected in flow through communication with hose means 20 at end section 34, permits pressurization of hose means 20 so that when hose means 20 is pressurized and expanded, threshold means 18 is contacted and moved from a horizontal position to a vertical position. In a preferred embodiment of system 14, threshold means 18 is rotated between the horizontal and vertical positions. While the choice of material for threshold means 18 is not crucial to the invention, sufficient material strength depending on the particular application is important. As illustrated in FIG. 1, preferred system 14 is shown in cooperative use with an aircraft hanger. Accordingly, threshold means 18 as illustrated should preferably be constructed of a material having sufficient strength to support movement of the aircraft 36 across upper surface 30. In the illustrated embodiment, therefore, threshold means 18 is preferably constructed of hardened steel plate.

Preferred fluid retaining system 14, partially illustrated in FIG. 2, comprises angled plate means 38 and hinge means 40. It is appreciated that system 14 may be constructed and arranged with hose means 20 positioned in a recess of base surface 16 so that threshold means 18 may be shaped as a flat plate, as later illustrated in FIGS. 8 and 9. As further shown in FIG. 2, angled plate means 38 consists of a pair of sloped side surfaces 42, 44 and a center surface 46 medially located between side surfaces 42, 44. Preferably, center surface 46 is substantially horizontally oriented in approximate parallel relation with base surface 16 when hose means 20 is not pressurized. Further, side surfaces 42, 44 preferably each lie in planes which intersect the plane of center surface 46. Slope angles of sloped side surfaces 42, 44 may vary according to individual application of system 14, however, preferred applications include slope angles sufficient to allow wheeled vehicles, such as aircraft 36, to readily move across threshold means 18 upper surface 30 into and out of enclosure 10.

Hinge means 40 permits a portion of threshold means 18 to rotate to a vertical fluid retaining position. Preferably, hinge means 40 is attached to side surface 42 of angled plate means 38 along the length of threshold means 18. Although numerous hinge configurations are sufficient for proper operation of system 14, a preferred hinge means 40 comprises a continuous hinge having a pin receiving section 50, a rotatable plate section 52 designed for attachment to angled plate means 42, and a stationary plate 54 designed for attachment to base surface 16 of enclosure 10. Pin means 56 is thus inserted and enclosed in pin receiving section 50. Means for mounting hinge means 40 to base 16 of walled enclosure 10 preferably includes a plurality of fasteners 58 extending through stationary plate 54 into base surface 16. In order to enhance a watertight seal between stationary plate 54 and base surface 16, and also to provide a levelling effect, tape means 59 may be utilized. Tape means 59 may include flexible double sided attaching tape having dimensions suitable for the particular application of system 14.

FIG. 2 further illustrates use of sheet means 63 which is positioned between threshold means 18, base surface 16, and wall 11 of enclosure 10 to retain liquids within enclosure 10 when threshold means 18 is rotated to a vertical position about pin means 56. Sheet means 63 is preferably attached to lower surface 32 of threshold means 18. Specifically, sheet means 63 is positioned between tape means 59 and stationary plate 54 and extends beneath the width W of angled plate means 38. Adhesive means 66, such as glue or the like provides adhesive attachment of sheet means 63 to various points on threshold means lower surface 32. Sheet means 63 should be a flexible and impermeable material which is preferably chemically resistant. Preferred sheet means 63 comprises reinforced silicone rubber material, although other materials may be utilized to achieve similar results.

Figure 3A:
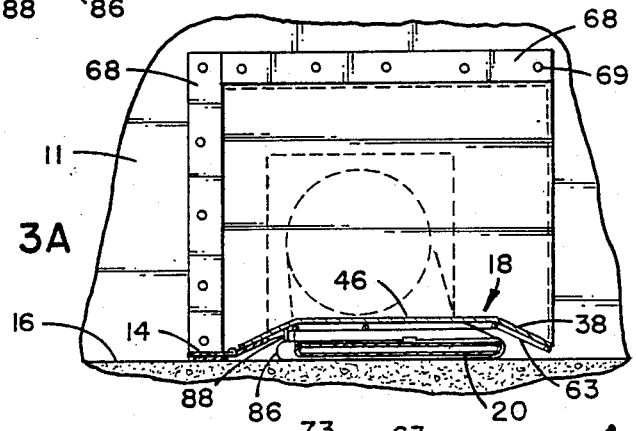
FIG. 3A is a side cross sectional view of an end section of a preferred embodiment fluid retaining system shown in a depressurized configuration.

Referring to FIG. 3A, a side cross sectional view of an end section of system 14 is shown in a non-activated configuration. As illustrated, threshold means 18 and, more specifically, angled plate means 38 center surface 46 is in a horizontal orientation, with hose means 20 in a depressurized configuration positioned beneath threshold means 18. Wall 11 of enclosure 10 includes retaining strip means 68 and retaining strip fasteners 69 for attaching a portion of sheet means 63 to wall 11. As will be later illustrated and described in detail, sheet means 63 extending between threshold means 18 and wall 11 retains liquids within the enclosure rather than permitting flow of such liquids through the interstices adjacent end sections 34, 35 and walls 11.

Figure 3B:
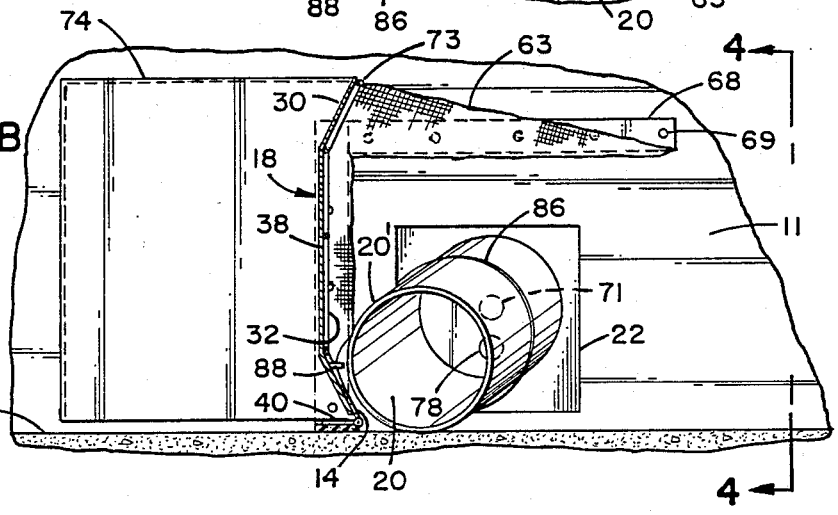
FIG. 3B is a side cross sectional view of an end section of a preferred embodiment fluid retaining system depicting the hose means in a pressurized configuration and the threshold means rotated to the vertical fluid retaining position.

FIG. 3B, which is analogous to the view of FIG. 3A, depicts system 14 in an actuated configuration in which pressurizing port 71 has supplied a pressurized medium to pressurize hose means 20 to a fully expanded shape. The expansion of hose means 20 resulted in an upper surface 20' thereof contacting a portion of lower surface 32 of threshold means 18. System 14 is preferably constructed so that a predetermined expansion of hose means 20 will result in rotational movement being imparted to a portion of threshold means 18, that portion preferably being angled plate means 38, until that portion of threshold means 18 is in a generally vertical orientation. The vertical orientation of threshold means 18 thus allows system 14 to function as a fluid retaining system for fluid within enclosure 10. Although not preferred, threshold means 18 may be rotated by a member extending between hose means 20 and lower surface 32. Such member may comprise an arm means or the like to transfer the force of hose means 20 to threshold means 18.

FIG. 3B further illustrates end section sealing means 73 comprising guard members 74 extending substantially perpendicularly from upper surface 30 of threshold means 18. Similarly constructed guard members 74 are attached to end sections 34, 35 of threshold means 18. Guard members 74 protect the interstices between end sections 34, 35, and wall 11 proximate each of the end sections. Specifically, guard members 74 provide protection for flexible sheet means 63 which extends between threshold means 18 and wall 11. Guard members 74 also provide means for maintaining angled plate means 38 in a substantially vertical orientation by contact with base surface 16, rather than allowing angled plate means 38 to rotate substantially beyond a vertical orientation. FIG. 3B also partially illustrates vent means 24 primary vent port 78 leading to primary vent line 79 (not shown). Further details regarding pressurization means 22 and vent means 24 are addressed in relation to the discussion of FIGS. 4 and 5.

Figure 7:
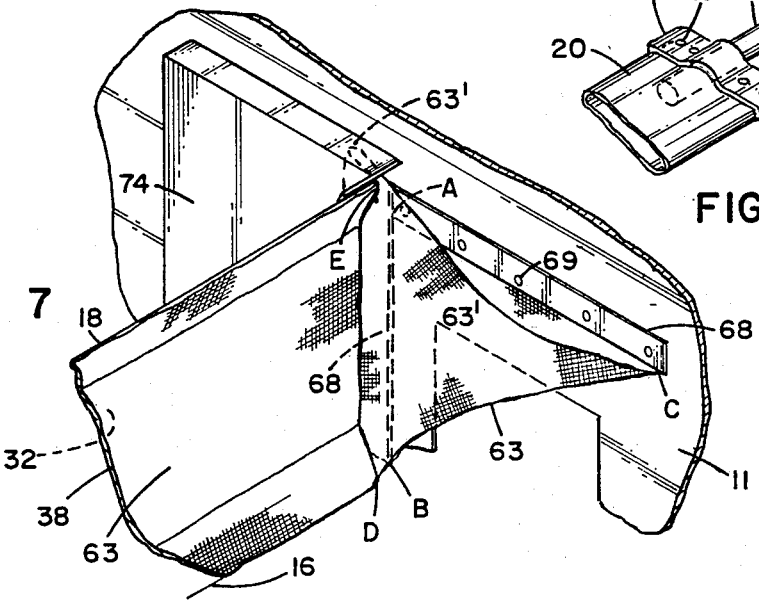
FIG. 7 is a fragmentary elevation view of a fluid retaining system threshold means end section depicting the preferred relation between the impermeable sheet means and the wall of the enclosure, the threshold means, and an end section guard member.

Further discussion of sheet means 63 and guard members 82 is included in relation to FIG. 7.

FIGS. 2, 3A, and 3B illustrate strapping means 86 which is circumferentially positioned around hose means 20. Strapping means 86 is attached to a surface of threshold means 18 to retain hose means 20 proximate hinge means 40 during pressurization of hose means 20. Preferably, loop means 88 is attached to lower surface 32 of threshold means 18 on angled plate means 38 to receive strapping means 86 therethrough and thus retain hose means 20 in a desired position. This positioning of hose means 20 maintains contact of hose means upper surface 20' against angled plate means 38 as hose means 20 is being pressurized, thereby maintaining rotational force against angled plate means 38 to achieve vertical orientation thereof. This positioning also maintains hose means 20 beneath angled plate means 38 during a depressurizing sequence to prevent damage to hose means 20 when angled plate means 38 is returned from a vertical orientation to a horizontal orientation.

It is appreciated that system 14 is preferably designed for use in access openings 12 of enclosures 10. Exemplary enclosures include aircraft hangers, paint spray booths such as those constructed by JBI Corporation, Osseo, WI, and other walled enclosures. However, system 14 may also be utilized in peripheral relationship to a particular piece of equipment or structure. As such, threshold means 18 could have an undulating path configuration which, of itself, creates a walled enclosure upon actuation. Such an alternate embodiment would, therefore, provide similar advantages to the preferred embodiment illustrated herein.

It should also be observed that system 14 is advantageous for retaining matter which may not be in a liquid state, but which nevertheless must be retained within an enclosed area. Examples of such matter include expended grease or safety vent discharge materials. Additionally, the operation of system 14 necessarily prevents certain access into various enclosures when actuated and is thus a suitable first order access barrier in the case of highly toxic matter which has spilled within the confines of system 14. In that case, system 14 may function to prevent, or warn against, individuals and equipment from accessing the confined space thereby reducing the risk of spreading the contaminated matter.

Figure 4:
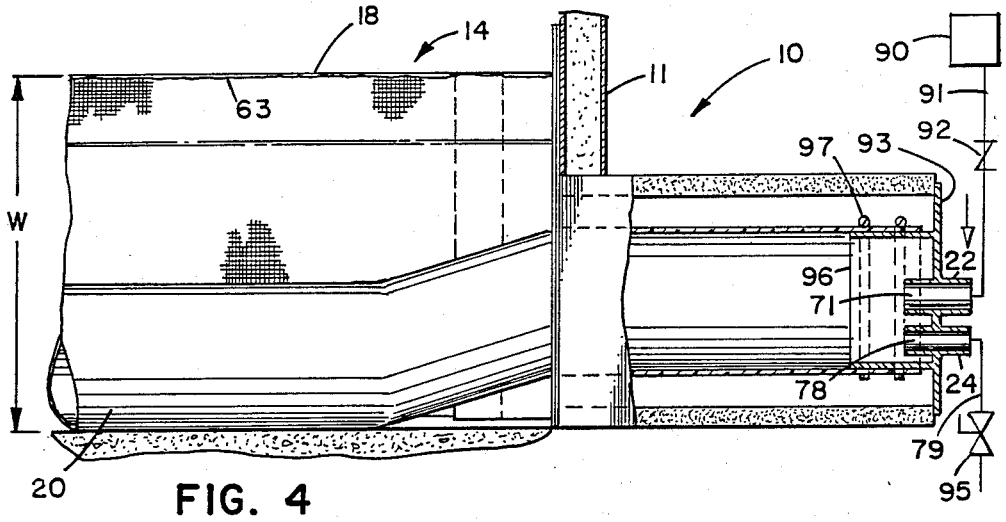
FIG. 4 is a rear elevation view taken generally along line 4—4, FIG. 3B, illustrating a fluid retaining system with the threshold means rotated to the vertical fluid retaining position and further illustrating a cross sectional view of a preferred means for pressurizing and venting the hose means.

FIG. 4 illustrates preferred system 14 with threshold means 18 and sheet means 63 in vertical, fluid retaining, position. The width W of angled plate means 38 generally defines the vertical height of system 14 in pressurized operation. Determination of the height required for each application is principally dependent on the volume of liquids which must be retained within the bounded area defined by system 14 and, in the preferred embodiment, enclosure 10. It is apparent, however, from FIG. 4 that hose means 20 and sheet means 63 are exposed to the fluids being retained. Accordingly, hose means 20 and sheet means 63 are preferably comprised of chemically resistant material to prevent untimely structural breakdown from exposure to various liquid chemicals which could otherwise erode the fluid-tight integrity of system 14. Suitable caulking material may be used at various boundary points throughout system 14.

FIG. 4 also provides a cross sectional view of end section 34 of threshold means 18 which illustrates a preferred structural cooperation of pressurizing means 22, a portion of vent means 24, sheet means 63, and threshold means 18. As depicted, pressurization means 22 comprises pressure source means 90, pressure inlet conduit 91, check valve 92, mounting plate means 93, and pressurizing port 71. In operation, a predetermined actuation permits pressure source means 90 to provide a pressurizing medium through pressure inlet conduit 91 and pressurizing port 71 to pressurize hose means 20. Suitable pressurizing mediums include various gases or liquids, such as air, Co2, water, or chemicals. Preferred system 14 utilizes water as a pressurizing medium. The pressure required of the pressurizing medium depends upon the force required to move the particularly configured threshold means 18 according to the specific application. Check valve 92 functions to maintain pressure within hose means 20 during pressurized operation when primary vent line 78 is closed. FIG. 4 also illustrates preferred means for attaching hose means 20 to mounting plate means 93 comprising hose fitting 96 suitable for receipt of hose means 20 and C-clamps 97 or other suitable attaching means.

Figure 5:
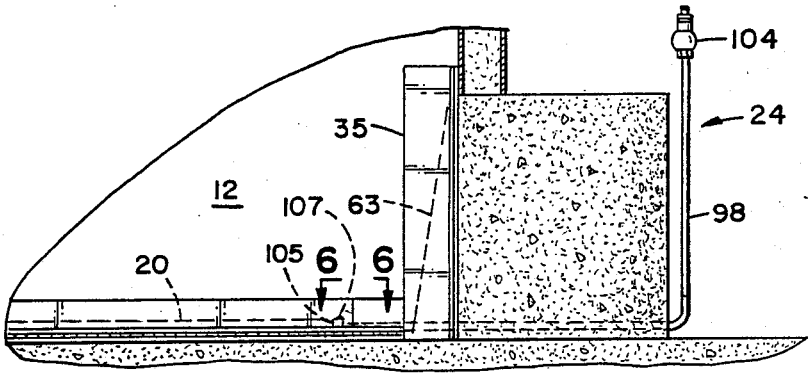
FIG. 5 is a front elevation view oriented generally along line 5—5, FIG. 2, illustrating a preferred vent means for removing air from the hose means during pressurization, the preferred embodiment vent means shown extending from the hose means through a wall of the enclosure.

Vent means 24, as preferably illustrated in FIG. 4, comprises primary vent port 78, primary vent line 79, and gate valve 95. Secondary vent line 98 and air vent means 104 also comprise portions of preferred vent means 24 and are illustrated in FIG. 5. Primary vent line 79 permits controlled venting of a pressurized medium when desired. Gate valve means 95, such as a manually operated dump valve, is provided, however other suitable means for discharging a pressurized medium from hose means 20 may be utilized.

FIG. 5 illustrates end section 35 of threshold means 18. More particularly, the relationship and manner of attachment of secondary vent line 98 to hose means 20 is illustrated. Preferably, secondary vent line 98 is provided to allow controlled venting of air from within hose means 20 at the point of actuation of pressurizing means 22 in order to permit complete pressurization of hose means 20. Thus, secondary vent line 98 provides conduit means for air between hose means 20 and air vent means 104. Secondary vent line 98 is preferably attached to hose means 20 by stockade clamp means 105 which is selectively tightened or loosened by threaded fasteners 107. Stockade clamp means 105 is preferably located beneath threshold means 18. While the particular choice of air vent means 104 is not crucial to the invention, one type of air vent has proven to be entirely successful and is preferred. This preferred vent is constructed to remove air from a liquid line, such as hose means 20, but also to prevent air from entering the liquid line from outside. Thus, FIGS. 4 and 5 illustrate preferred fluid retaining system 14 which includes means for selectively pressurizing and venting hose means 20 comprising valve means configured in flow through communication with hose means 20. It should be appreciated that an alternate embodiment fluid retaining system may include hose means 20 which allows flow-through of a pressurized medium, such as water,- from both ends of a hose means. For example, a fire suppression system may include a partial bypass line through which fire, fighting liquid is bypassed and which functions as the pressurized medium as it passes through hose means 20 enroute to use as the fire suppression agent.

Figure 6:
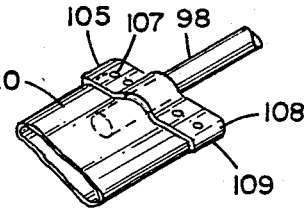
FIG. 6 is a fragmentary perspective view taken generally along line 6—6, FIG. 5, of a preferred means for attaching the air vent means conduit to the hose means.

FIG. 6 is a fragmentary view of a preferred means for connecting air vent means 104, secondary vent line 98, and hose means 20. Preferred stockade clamp means 105 is provided to secure hose means 20 in clamped relation around secondary vent line 98. Adjustable fasteners 107 permit variable clamping of two clamping members 108, 109.

FIG. 7 illustrates preferred sheet means 63 in fluid retaining operation with wall 11, guard member 74, and threshold means 18 angled plate means 38. As shown, sheet means 63 is attached to lower surface 32 of angled plate means 38, and extends between angled plate means 38 and wall 11 to form a fluid retaining boundary. As previously described, wall 11 comprises retaining strip means 68, which may be constructed of galvanized steel, and retaining strip fasteners 69, to attach sheet means 63 to wall 11. Accordingly, sheet means 63 is preferably attached to wall 11 along line A-C and along line A-B. A portion of sheet means 63 is also attached to base surface 16 between points B-D. The portion of sheet means 63 extending between point C on wall 11 and point E on angled plate means 38 thus comprises a moving flap 63' which provides fluid retaining operation when angled plate means 38 is vertically oriented. Moreover, flap 63' is constructed and arranged to be readily received within guard member 74 when hose means 20 is depressurized and angled plate means 38 is restored to a substantially horizontal orientation. Thus, sheet means 63, including flap 63', is protected from damage when not in use.

Figure 8:
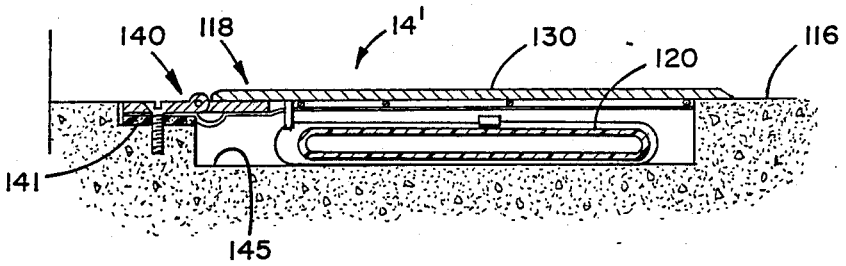
FIG. 8 is a side cross sectional view of an alternate embodiment fluid retaining system illustrating a depressurized hose means positioned beneath a flush mounted rotatable threshold means.
Figure 9:
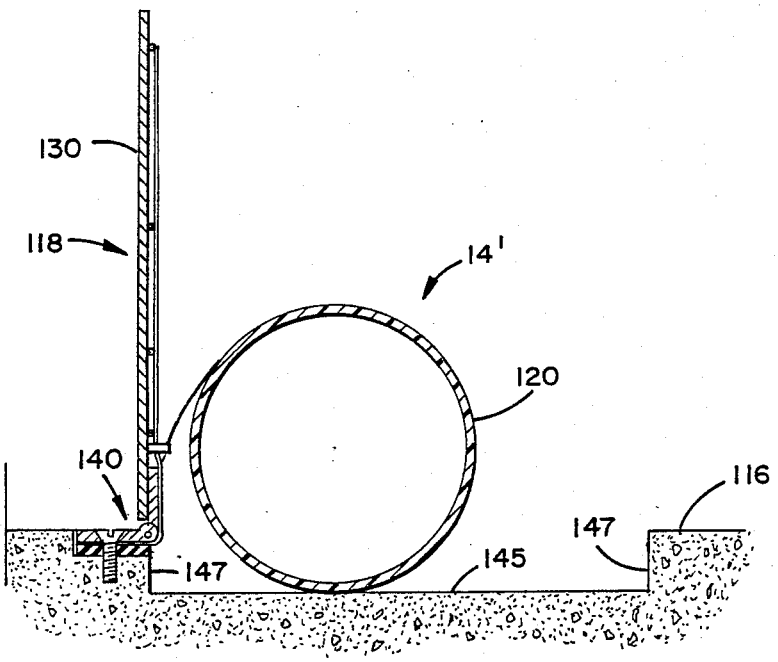
FIG. 9 is a side cross sectional view of an alternate embodiment fluid retaining system depicting the hose means in a pressurized configuration and the threshold means in a vertical fluid retaining position.

Referring to FIGS. 8 and 9, a system 14' for retaining liquids within an enclosure is illustrated. System 14' of FIGS. 8 and 9 comprises substantially the same elements, and functions substantially identically to, system 14 illustrated in FIGS. 1–7.

As shown in FIG. 8, a flexible inflatable member in the form of hose means 120 is positioned beneath threshold means 118. Preferably, base surface 116 is constructed and arranged for receipt of hinge means 140 and hose means 120 so that threshold means 118 is within substantially the same plane as base surface 116. This is preferably accomplished by positioning hinge means 140 on a shelf 141 having a horizontal surface lying in a plane below base surface 116. Further, hose means 120 is preferably positioned on a surface 145 which is also in a plane below base surface 116. Thus, threshold means 118 may be comprised of a substantially flat plate having an upper surface 130 to facilitate movement of wheeled vehicles across system 14'.

FIG. 9 further illustrates the operation of system 14' which is substantially the same as system 14 illustrated in FIGS. 1–7 with the exception of the shape of the threshold means and the use of lowered surfaces 141 and 145 which tend to lower the height of system 14 above base surface 116. The construction of system 14' with surface 145 provides enhanced capabilities for retaining fluids within the hose means retaining pit formed by surface 145 and walls 147.

A method of retaining liquids within a defined area, such as enclosure 10, may also be implemented, preferably utilizing system 14. A preferred method includes a step of placing a flexible inflatable member in the form hose means 20 across the liquid flow path out of the defined area. A movable threshold means 18 is then positioned over hose means 20. Hose means 20 is then connected with a means for pressurizing hose means 20 so that the pressurization and expansion of hose means 20 imparts movement to threshold means 18. This movement thus repositions threshold means 18 from a horizontal position to a substantially vertical position in order to retain liquids within the defined retaining area. As previously explained with respect to system 14, this method provides protection against outflow of hazardous liquids or other flowable matter from defined areas such as illustrated by enclosure 10 herein.

It is to be understood that while certain embodiments of the present invention have been illustrated and described, the invention is not to be limited to the specific forms or arrangement of parts described and shown above, since others skilled in the art may devise other embodiments still within the limits of the claims.

What is claimed is:

1. A system for retaining liquids within an enclosure comprising:

(a) threshold means for retaining liquids within an enclosure, the threshold means being located on a base surface of the enclosure and comprising a rigid upper surface, a rigid lower surface, and two end sections, the threshold means being movable between a first horizontal position and a second vertical position;

(b) a flexible inflatable member in the form of hose means positioned beneath the threshold means; and (c) means for pressurizing the hose means so that the pressurization and expansion of the hose means imparts movement to the threshold means and positions the threshold means to retain liquids within the enclosure.

2. A system according to claim 1 wherein the threshold means comprises:

(a) angled plate means consisting of a pair of sloped side surfaces and a center surface medially located between the side surfaces, the center surface being substantially horizontally oriented and the side surfaces lying in a plane intersecting the horizontal when the hose means is depressurized and the threshold means is in the first horizontal position; and (b) hinge means attached to a side surface of the angled plate means.

3. A system according to claim 2 wherein the hinge means is a continuous hinge comprising:

(a) pin means;

(b) a pin receiving section;

(c) a rotatable plate section for attachment to the angled plate means; and (d) a stationary plate for attachment to the base surface of the enclosure.

4. A system according to claim 3 wherein the means for mounting the hinge means to the base of enclosure comprises a plurality of fasteners extending through the hinge means stationary plate into the base surface of the enclosure.

5. A system according to claim 4 wherein the means for mounting the hinge means to the base of the walled enclosure further comprises flexible tape means affixed between the hinge means stationary plate and the base surface of the enclosure.

6. A system according to claim 1 further comprising flexible and impermeable sheet means positioned between the threshold means and the base surface of the enclosure to contain liquids within the enclosure when the threshold means is rotated to the vertical position.

7. A system according to claim 6 wherein the sheet means comprises reinforced silicone rubber adhesively bonded to the threshold means.

8. A system according to claim 2 further comprising:

(a) strapping means circumferentially positioned around the hose means; and (b) loop means attached to a surface of the angled plate means facing the hose means, the loop means being constructed and arranged for receipt of the strapping means therethrough to retain the hose means proximate the hinge means when the hose means is pressurized.

9. A system according to claim 1 wherein the hose means comprises a chemical resistant material.

10. A system according to claim 6 further comprising end section sealing means constructed and arranged for sealing the interstices between the threshold means end sections and walled portions of the enclosure and for maintaining the threshold means at a vertical position when the hose means is pressurized, the end section sealing means comprising:

(a) flexible sheet means extending between the threshold means and walled portions of the enclosure adjacent the end sections of the threshold means; and (b) guard members extending substantially perpendicularly from the upper surface of the threshold means end sections constructed and arranged for positioning over the flexible sheet means when the threshold means is in the horizontal position and for supporting the threshold means in the vertical position when the hose means is pressurized.

11. A system according to claim 1 wherein the means for pressurizing the hose means comprises:

(a) valve means configured in flow-through communication with the hose means, the valve means permitting selective pressurization of the hose means from a pressure source; and (b) vent means to remove air from the hose means during pressurization and to selectively vent the pressurized medium from the hose means.

12. A system for retaining liquids within a walled enclosure comprising:

(a) an enclosure comprising a horizontally oriented base surface and vertically oriented sidewalls extending from the base surface, (b) threshold means located on the base surface of the enclosure, the threshold means having an upper surface, a lower surface, and two end sections, the threshold means being movable between a first horizontal position and a second vertical position;

(c) a flexible inflatable member in the form of hose means positioned beneath the threshold means;

(d) means for pressurizing the hose means so that the pressurization and expansion of the hose means imparts movement to the threshold means and repositions the threshold means from the horizontal position to the vertical position; and (e) flexible and impermeable sheet means positioned between the threshold means and the base surface of the enclosure to retain liquids within the walled enclosure when the threshold means is rotated to the vertical position.

13. A system according to claim 12 wherein the threshold means comprises:

(a) angled plate means consisting of a pair of sloped side surfaces and a center surface medially located between the side surfaces, the center surface being substantially horizontally oriented and the side surfaces lying in a plane intersecting the horizontal when the hose means is depressurized and the threshold means is in the first horizontal position; and (b) hinge means attached to a side surface of the angled plate means.

14. A system according to claim 13 wherein the hinge means is a continuous hinge comprising:

(a) pin means;

(b) a pin receiving section;

(c) a rotatable plate section for attachment to the angled plate means; and (d) a stationary plate for attachment to the base surface of the enclosure.

15. A system according to claim 14 wherein the means for mounting the hinge means to the base of the enclosure comprises:

(a) flexible tape means affixed between the hinge means stationary plate and the base surface of the enclosure; and (b) a plurality of fasteners extending through the hinge means stationary plate and the flexible tape means into the base surface of the enclosure.

16. A system according to claim 12 wherein the sheet means comprises reinforced silicone rubber adhesively bonded to the threshold means.

17. A system according to claim 12 further comprising:

(a) strapping means circumferentially positioned around the hose means; and (b) loop means attached to a surface of the angled plate means facing the hose means, the loop means being constructed and arranged for receipt of the strapping means therethrough to retain the hose means proximate the hinge means when the hose means is pressurized.

18. A system according to claim 12 further comprising end section sealing means constructed and arranged for sealing the interstices between the threshold means end section and walled portions of the enclosure and to maintain the threshold means at a vertical position when the hose means is pressurized, the end section sealing means comprising:

(a) flexible sheet means extending between the threshold means and walled portions of the enclosure adjacent the end sections of the threshold means; and (b) guard members extending substantially perpendicularly from the upper surface of the threshold means end sections, the rigid guard members being constructed and arranged for positioning over the flexible sheet means when the threshold means is in the horizontal position and for supporting the threshold means in the vertical position when the hose means is pressurized.

19. A system according to claim 12 wherein the means for pressurizing the hose means comprises:

(a) valve means configured in flow-through communication with the hose means, the valve means permitting selective pressurization of the hose means from a pressure source; and (b) vent means to remove air from the hose means during pressurization and to selectively vent the pressurized medium from the hose means.

20. A hydraulically actuated system for retaining fire fighting fluid runoff within a walled enclosure, the system comprising:

(a) an enclosure having walls on substantially all sides of a base, and with at least one portion of the base having no wall;

(b) threshold means extending across the nonwalled portion of the base, the threshold means having upper and lower rigid surfaces, two end sections, and hinge means, the hinge means being attached to the base of the enclosure to permit selective movement of a portion of the threshold means between a first horizontal position and a second vertical position;

(c) a flexible inflatable member in the form of a hose constructed and arranged for the selective flow of fire fighting fluids therethrough, the hose being positioned beneath a length of the threshold means; and (d) hydraulic means for pressurizing the hose so that pressurization and expansion of the hose means imparts movement to a portion of the threshold means and repositions that portion of the threshold means to the second vertical position to retain expended fire fighting fluids within the walled enclosure.

21. A system according to claim 20 wherein the threshold means is constructed and arranged to permit travel of a wheeled vehicle across the upper surface into and out of the walled enclosure.

22. A system according to claim 20 further comprising flexible and impermeable sheet means positioned between the threshold means and the base surface of the enclosure to contain liquids within the walled enclosure when the threshold means is rotated to the vertical position.

23. A system according to claim 22 wherein the sheet means comprises reinforced silicone rubber adhesively bonded to the lower surface of the threshold means.

24. A system according to claim 20 further comprising end section sealing means constructed and arranged for sealing the interstices between the threshold means end section and walled portions of the enclosure and to maintain the threshold means at a vertical position when the hose means is pressurized, the end section sealing means comprising:

(a) flexible sheet means extending between the threshold means and walled portions of the enclosure adjacent the end sections of the threshold means; and (b) guard members extending substantially perpendicularly from the upper surface of the threshold means end sections, the guard members being constructed and arranged for positioning over the flexible sheet means when the threshold means is in the horizontal position and for supporting the threshold means in a vertical orientation when the hose means is pressurized.

25. A system according to claim 24 further comprising:

(a) strapping means circumferentially positioned around the hose means; and (b) loop means attached to the lower surface of the threshold means facing the hose means, the loop means being constructed and arranged for receipt of the strapping means therethrough to retain the hose means beneath the threshold means proximate the hinge means.

26. A method of retaining liquids within a defined area comprising the steps of:

(a) placing a flexible inflatable member in the form of hose means across the liquid flow path out of a defined area;

(b) positioning a movable hinged and rigid threshold means on top of the hose means; and (c) connecting the hose means to a hydraulic pressure source so that pressurization and expansion of the hose means imparts movement to the threshold means and repositions the threshold means from a horizontal position to a vertical position to retain liquids within the defined area.

* * * * *